United States Patent [19]

Hagemann et al.

[11] Patent Number: 4,685,476

[45] Date of Patent: Aug. 11, 1987

[54] APPARATUS FOR SUPPLYING PARTICLES OF TOBACCO TO PROCESSING MACHINES

[75] Inventors: Fritz Hagemann, Hamburg; Klaus Hagenah, Geesthacht, both of Fed. Rep. of Germany

[73] Assignee: Hauni-Werke Körber & Co. KG, Hamburg, Fed. Rep. of Germany

[21] Appl. No.: 807,360

[22] Filed: Dec. 10, 1985

[30] Foreign Application Priority Data

Dec. 22, 1984 [DE] Fed. Rep. of Germany ..... 3447261

[51] Int. Cl.[4] ..... A24C 5/18; A24C 5/39

[52] U.S. Cl. ..... 131/110; 131/108; 131/909; 406/14

[58] Field of Search ..... 131/108, 109.1, 109.2, 131/110; 406/14, 171, 172

[56] References Cited

U.S. PATENT DOCUMENTS

| | | | |
|---|---|---|---|
| 2,826,459 | 3/1958 | Oetiker | 406/14 |
| 3,386,773 | 6/1968 | Ballard, Jr. | 131/110 |
| 3,580,644 | 5/1971 | Ballard, Jr. | 131/110 |
| 4,402,635 | 9/1983 | Maruo | 406/14 |
| 4,458,698 | 7/1984 | Brackmann | 131/110 |
| 4,587,979 | 5/1986 | Hagemann et al. | 131/109.2 |
| 4,607,987 | 8/1986 | Kice | 406/14 |

FOREIGN PATENT DOCUMENTS

| | | | |
|---|---|---|---|
| 811578 | 8/1951 | Fed. Rep. of Germany | 406/14 |

*Primary Examiner*—V. Millin
*Assistant Examiner*—H. Macey
*Attorney, Agent, or Firm*—Peter K. Kontler

[57] ABSTRACT

Tobacco shreds are drawn from a magazine by a pneumatic conveyor pipe which delivers the shreds into the lower chamber of an air separator whose upper chamber is separated from the lower chamber by an air-permeable partition and is connected with the inlet of a suction generating device serving to draw an air stream through the pneumatic conveyor pipe. The velocity of the air stream in the pipe is maintained at a constant value by a flow restrictor which is installed in the inlet of the suction generating device and is adjustable by hand or by a servomotor receiving signals from a device which ascertains the velocity of air in the pipe by comparing the velocity of air in the second chamber with the velocity of air in the inlet of the suction generating device. The air separator has an outlet for periodical admission of batches of tobacco shreds from the first chamber into a duct which delivers the shreds into the distributor of a cigarette rod making machine.

8 Claims, 1 Drawing Figure

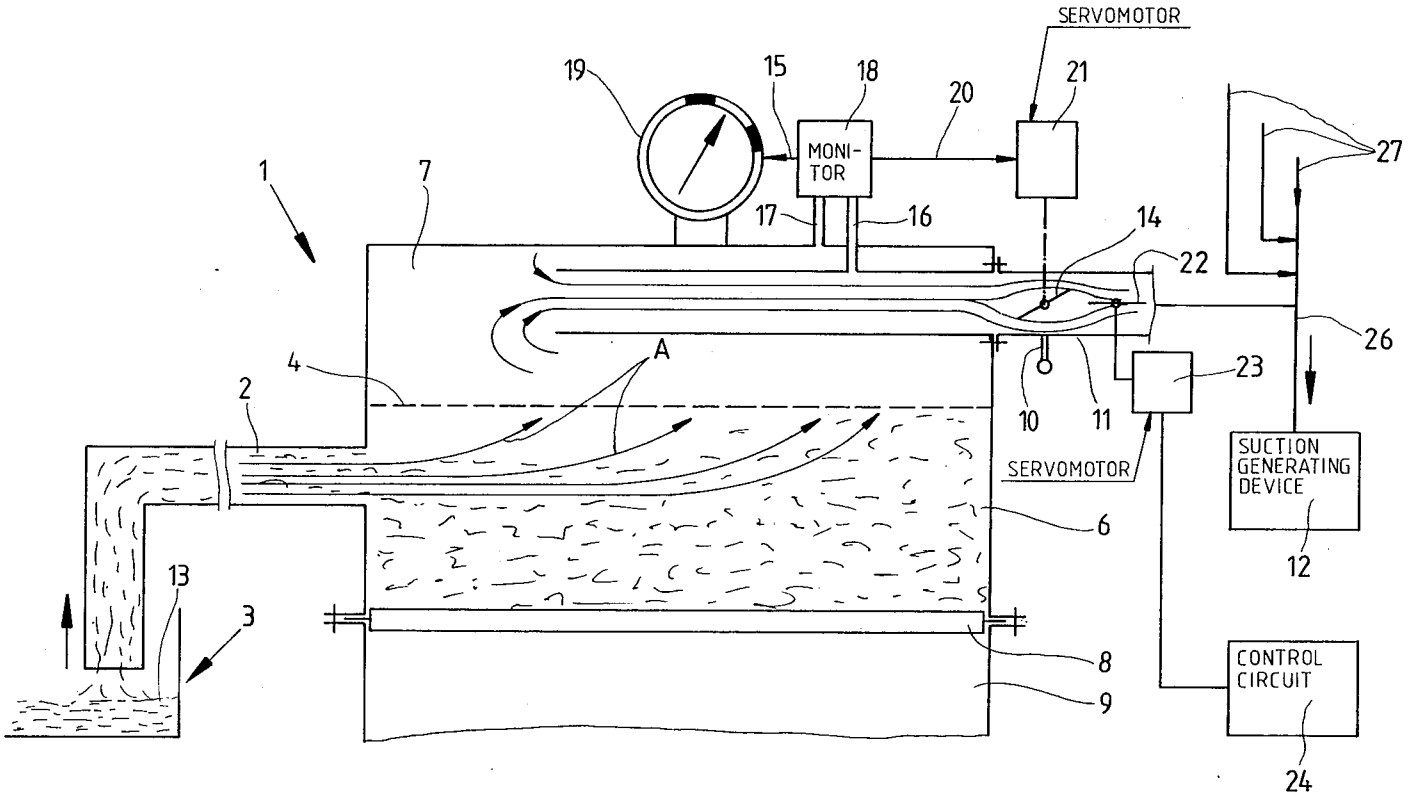
SUCTION GENERATING DEVICE
CONTROL CIRCUIT
SERVOMOTOR
SERVOMOTOR
MONI-TOR
A
1
2
3
4
6
7
8
9
10
11
12
13
14
15
16
17
18
19
20
21
22
23
24
26
27

APPARATUS FOR SUPPLYING PARTICLES OF TOBACCO TO PROCESSING MACHINES

BACKGROUND OF THE INVENTION

The present invention relates to apparatus for transporting particulate materials, especially shreds or otherwise configurated fragments of tobacco including natural, reconstituted and substitute tobacco.

It is well known to transport a continuous or an interrupted flow of shredded or otherwise comminuted tobacco leaves, comminuted sheets of reconstituted tobacco and/or fragments of substitute tobacco in a gaseous carrier medium (normally air) which conveys the particles from a suitable source into the distributor of a cigarette rod making or other tobacco processing machine. It is also known to equip such apparatus with an air separator which segregates the transported particles from the carrier medium. As a rule, the air separator has a first chamber which receives the carrier medium and the particles therein, and a second chamber which is separated from the first chamber by an air-permeable partition and is connected with the inlet of a suction generating device. This ensures that the conveyed particles are collected in the first chamber and that the carrier medium is withdrawn by way of the partition and second chamber. It is further known to install an adjustable flow restrictor in the inlet of the suction generating device. The air separator has an outlet which can be actuated to admit batches of intercepted tobacco particles into the distributor of a cigarette rod making machine. The outlet is actuated in dependency on the requirements of the distributor so that the magazine of the distributor (also called hopper) contains an optimum quantity of comminuted tobacco particles. It is desirable that the magazine of the distributor be filled to a predetermined level and that the particles of tobacco be prevented from accumulating into clumps (e.g., into aggregations of interlaced tobacco shreds) which would be likely to interfere with the making of a homogoneous tobacco filler having predictable characteristics and being convertible into a satisfactory tobacco rod.

An apparatus which transports particles of natural, artificial or reconstituted tobacco to a processing machine (e.g., to a cigarette, cigarillo or cigar maker) must satisfy numerous additional requirements in order to further enhance the likelihood of making a highly satisfactory tobacco filler which is ready to be draped into a web of cigarette paper or other wrapping material for conversion into a continuous rod which is thereupon subdivided into sections of unit length or multiple unit length. Thus, the consistency of tobacco particles (such as the length and other characteristics of shreds) as well as the mixture of particles (e.g., the mixture of shorter and longer shreds or the mixture of two or more different tobacco blends) should not be adversely or overly affected by the gaseous carrier medium which is used to transport the particles from a main source of supply into the air separator. Moreover, if the characteristics of conveyed material are to be changed or influenced, such changing or influencing should be carried out in a highly reproducible manner. The velocity of the gaseous carrier medium in the pneumatic conveyor which transports the particles of tobacco from the main source into the first chamber of the air separator is a parameter which plays an important role in the operation of pneumatic tobacco transporting apparatus. The velocity of the gaseous carrier medium must be selected in such a way that it reduces the likelihood of or eliminates adverse influence of the carrier medium upon the consistency of tobacco particles while, at the same time, ensuring that the distributor of a modern high-speed tobacco processing machine (e.g., a cigarette maker which turns out up to and in excess of 8000 cigarettes per minute) receives adequate quantities of comminuted tobacco.

OBJECTS AND SUMMARY OF THE INVENTION

An object of the invention is to provide an apparatus for conveying flowable particulate material, particularly fragments of tobacco leaves, in such a way that the material can be conveyed in larger or smaller quantities, through shorter or longer distances and at a single level or between different levels without unduly affecting its desirable characteristics such as size, extent of interlacing, minimal formation of dust and/or others.

Another object of the invention is to provide an apparatus which can be adjusted to regulate the rate of transport of flowable particulate material as well as the influence of transport in a gaseous carrier medium upon the desirable characteristics of the particulate material and/or of the commodities into which the particulate material is converted.

A further object of the invention is to provide novel and improved means for monitoring and regulating the velocity of a gaseous carrier medium for fragments of tobacco leaves or like particulate material.

An additional object of the invention is to provide the apparatus with novel and improved means for manually or automatically adjusting the velocity of the gaseous carrier medium when such velocity deviates from an optimum value.

Still another object of the invention is to provide a novel and improved method of conveying large or small quantities of comminuted tobacco leaves or the like from a first to a second magazine.

An additional object of the invention is to provide a novel and improved air separator for use in the above outlined apparatus and for the practice of the above outlined method.

One feature of the invention resides in the provision of an apparatus for conveying or transporting a flowable particulate material (this term is intended to embrace, among others, fragments of natural tobacco leaves, fragments of sheets of reconstituted tobacco as well as fragments of substitute tobacco) from a source of particulate material. The apparatus comprises an air separator having first and second chambers and including an air-permeable partition between the two chambers, a pneumatic conveyor having an inlet in the source and an outlet in the first chamber, and a suction generating device which is connected with the second chamber to induce the flow of an air stream from the source, through the conveyor, first chamber and partition and into and from the second chamber so that the stream entrains particulate material into the first chamber with attendant separation of such material from air which passes through the partition and into the second chamber. The apparatus further comprises means for monitoring the velocity of the air stream in the conveyor. The air separator is preferably provided with a sealable outlet for evacuation of particulate material from the first chamber, e.g., with a mobile bottom wall which can be actuated to periodically evacuate particulate material from the first chamber by gravity feed.

The apparatus preferably further comprises an adjustable flow restrictor which can be installed in the tubular inlet means of the suction generating device. The monitoring means is preferably designed to generate signals which denote the velocity of air in the conveyor and which are transmitted to a servomotor or other suitable means for adjusting the flow restrictor so as to maintain the velocity of the air stream in the conveyor at a substantially constant value, i.e., within an acceptable range of velocities. The monitoring means can comprise means for comparing the air pressure in the second chamber with the air pressure in the inlet of the suction generating device. The aforediscussed signals are then indicative of the difference between the two pressures and such difference is indicative of velocity of the air stream in the conveyor.

A shutoff valve or other suitable means can be provided for selectively sealing the second chamber of the air separator from the suction generating device. Such sealing means is particularly desirable when the suction generating device has several inlets (or the inlet of the suction generating device has several branches) each of which can draw air from the second chamber of a discrete air separator. Thus, one of the air separators can be deactivated while the other air separator or separators continue to gather particulate material for periodic admission into the distributors of discrete cigarette making or other tobacco processing machines.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a schematic partly elevational and partly vertical sectional view of an apparatus which embodies the present invention and wherein the suction generating device can draw air from several air separators.

DESCRIPTION OF THE PREFERRED EMBODIMENTS

The drawing shows an air separator 1 whose housing defines a first chamber 6 and a second chamber 7 which latter is disposed at a level above the chamber 6 and is separated therefrom by a horizontal air-permeable partition 4 in the form of a sieve having a mesh such as to intercept the particles 13 of comminuted tobacco which are drawn from a main source 3 (e.g., a large magazine) by the inlet of a pneumatic conveyor 2 whose outlet communicates with the chamber 6. The bottom wall 8 of the housing of the air separator 1 is a flap which can be pivoted at desired intervals in order to dump batches of accumulated tobacco particles 13 into a chute 9 which, in turn, admits the batches into the single magazine or into the first of several magazines of a distributor or hopper in a cigarette rod making machine, e.g., a machine known as PROTOS which is manufactured and sold by the assignee of the present application.

The upper chamber 7 of the air separator 1 communicates with the tubular inlet 11 of a suction generating device 12 (e.g., a large blower or fan), and the inlet 11 contains an adjustable flow restrictor in the form of a flap 14 which is pivotable about a horizontal axis by an adjusting means in the form of a suitable servomotor 21 so as to regulate the velocity of the air stream which flows in the conveyor 2 to transport tobacco particles 13 from the main source 3 into the chamber 6. The direction of flow of the air stream is indicated by the arrows A; such stream enters the chamber 6 and is separated from the particles 13 by the partition 4 before entering the chamber 7 and thence the inlet 11 of the suction generating device 12. The segregated particles 13 descend by gravity and accumulate on the bottom wall 8 to be periodically admitted into the duct 9 for transport into the distributor of the processing machine.

Each angular position of the flap 14 corresponds to a different velocity of the air stream in the conveyor 2. Such velocity is ascertained by a monitoring device 18 which compares the pressure of air in the inlet 11 of the suction generating device 12 with the pressure of air in the chamber 7 of the air separator 1. The means for connecting the inlet 11 with the monitoring device 18 comprises a first conduit 16, and a second conduit 17 is provided to connect the device 18 with the chamber 7. The device 18 contains an electropneumatic transducer which generates signals denoting the pressure differential between the interior of the inlet 11 and the chamber 7. Such signals are transmitted to the servomotor 21 by way of first conductor means 20, and to a signal displaying means 19 (e.g., a conventional gauge) by way of second conductor means 15.

Since the difference between the pressures of air in the inlet 11 and chamber 7 is indicative of the velocity of the air stream in the conveyor 2, an attendant who observes the dial of the gauge 19 can ascertain whether or not the velocity is satisfactory and can adjust the angular position of the flap 14 so as to restore the desired velocity, i.e., to ensure that the velocity will remain within the acceptable range. The schematically illustrated handle 10 can be used to change the angular position of the flap 14 so as to alter the velocity of the air stream in the conveyor 2, if and when necessary.

However, it is presently preferred to provide the aforementioned servomotor 21 which automatically changes the position of the flow restricting flap 14 whenever the monitored velocity of the air stream in the conveyor 2 deviates from the desired or optimum value. This renders it possible to ensure that the apparatus will operate satisfactorily without any supervision on the part of attendants. The arrangement is such that the servomotor 21 causes the flap 14 to maintain the velocity of the air stream in the conveyor 2 at a constant or nearly constant value. Such value is selected with a view to minimize and uniformize the damage to the particles of tobacco which are transported from the main source 3 into the lower chamber 6 of the air separator 1. This, in turn, enables the distributor of the processing machine to produce a highly satisfactory tobacco filler which is ready to be trimmed (if necessary) and draped into a web of cigarette paper or the like in a manner well known from the art of rod making machines which turn out cigarettes, cigars, cigarillos and other rod-shaped smokers' products.

The drawing further shows a shutoff valve 22 which is installed in the inlet 11 of the suction generating device 12 downstream of the flap 14 and constitutes a means for selectively sealing the air separator 1 from the suction generating device. A servomotor 23 is provided to move the shutoff valve 22 between open and closed positions, and this servomotor receives appropriate signals from the controls 24 of the processing machine. Thus, the controls 24 will cause the servomotor 23 to close the valve 22 when the respective processing machine is idle for the purposes of repair, inspection or for another reason. Alternatively, the controls 24 can transmit signals to open the shutoff valve 22 whenever the air separator 1 is to begin with the accumulation of a batch of particles 13 preparatory to dumping of the batch into the chute 9 which delivers the batch into the distributor of the machine whose controls are shown at 24. The controls 24 seal the air separator 1 from the suction generating device 12 as soon as the chamber 6 has accumulated a satisfactory batch of particles 13.

The provision of a shutoff valve 22 in the inlet 11 of the suction generating device 12 is particularly desirable and advantageous when the device 12 is provided with several inlets (note the three additional inlets 27) each of which can draw air from a discrete air separator serving to gather batches of tobacco particles for admission into the distributors of additional processing machines. The energy requirements of the suction generating device 12 can be reduced considerably by keeping open only that shutoff valve 22 which permits evacuation of air from the air separator that is about to accumulate a batch of particles 13. The character 26 denotes a conduit which is connected with the inlets 11 and 27 to draw air into the suction generating device 12 proper.

An important advantage of the improved apparatus is its simplicity and its versatility. Thus, the velocity of the air stream in the conveyor 2 can be monitored in a very simple and inexpensive way, and such velocity can be changed either by hand or automatically on observation of or in response to signals from the monitoring device 18. As mentioned above, the velocity of the air stream in the conveyor 2 is an important factor which influences the condition of the conveyed particulate material and hence the quality of the ultimate product. More specifically, an important beneficial effect of constant velocity of the air stream in the conveyor 2 is that this reduces the likelihood of non-uniform adverse influencing of tobacco particles which are on their way from the main source 3 into the chamber 6 of the air separator 1 so that the operators can anticipate the extent of damage (if any) to the particles 13 which enter the duct 9 to be admitted into the distributor of the processing machine.

U.S. Pat. No. 3,580,644 discloses an apparatus wherein a monitoring device ascertains the difference between the pressure of air in the pneumatic conveyor and the air-collecting chamber of the air separator. The pressure differential is monitored for the purpose of ascertaining the extent to which the sieve of the air separator is covered (and clogged) by tobacco particles which are drawn from a main source of supply into the other chamber of the air separator. The signal which is generated by the monitoring device which is used in the patented apparatus serves to effect an opening of the gate which permits evacuation of accumulated tobacco particles from the respective chamber of the air separator. The arrangement is such that the gate opens automatically when the pressure differential between the interior of the conveyor and the air-collecting chamber of the air separator reaches a preselected value. The velocity of tobacco particles which travel from the main source toward the air separator does not influence the pressure differential between the interior of the conveyor and the air collecting chamber of the air separator.

A similar apparatus is disclosed in the commonly owned German Offenlegungsschrift No. 34 16 701 wherein the pressure differential between the interior of the conveyor and the air collecting chamber of the air separator again denotes the extent to which the sieve between the two chambers of the air separator is covered by tobacco particles. The monitoring device 18 may be of the type known as KrD72S-SCH 46593 by the assignee of this application.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for conveying a flowable particulate material, particularly fragments of tobacco leaves, comprising a source of particulate material; an air separator having first and second chambers and including an air-permeable partition between said chambers; an pneumatic conveyor having an inlet communicating with said source and an outlet communicating with said first chamber; a suction generating device having inlet means communicating with said second chamber to induce the flow of an air stream from said source, through said conveyor, said first chamber and said partition and into and from said second chamber whereby the stream entrains particulate material into said first chamber with attendant separation of such material from air which passes through said partition on its way into said second chamber; and means for monitoring the velocity of the air stream in said conveyor, including means for comparing the pressure of air in said second chamber with the pressure of air in said inlet means.

2. The apparatus of claim 1, wherein said separator has a sealable outlet for evacuation of particulate material from said first chamber.

3. The apparatus of claim 1, further comprising an adjustable flow restrictor installed in said inlet means and arranged to vary the velocity of air in said conveyor.

4. The apparatus of claim 3, wherein said monitoring means includes means for generating signals denoting the velocity of air in said conveyor, and further comprising means for adjusting said flow restrictor in response to said signals so as to maintain the velocity of air in said conveyor at a substantially constant value.

5. The apparatus of claim 1, wherein said monitoring means further comprises means for generating signals denoting the difference between the air pressure in said second chamber and the air pressure in said inlet means.

6. The apparatus of claim 5, wherein said difference is indicative of the velocity of air in said conveyor, and further comprising means for displaying said signals.

7. The apparatus of claim 1, further comprising means for selectively sealing said second chamber from said suction generating device.

8. The apparatus of claim 1, wherein said air separator comprises means for periodically evacuating particulate material from said first chamber.

* * * * *